US008050435B2

(12) United States Patent
Nishizaki et al.

(10) Patent No.: US 8,050,435 B2
(45) Date of Patent: Nov. 1, 2011

(54) HEARING AID FITTING APPARATUS

(75) Inventors: Makoto Nishizaki, Tokyo (JP); Toshiya Hosotani, Ehime (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/957,782

(22) Filed: Dec. 1, 2010

(65) Prior Publication Data

US 2011/0164772 A1 Jul. 7, 2011

(30) Foreign Application Priority Data

Dec. 1, 2009 (JP) ..... 2009-273084

(51) Int. Cl.
*H04R 25/00* (2006.01)

(52) U.S. Cl. ..... 381/312; 381/60

(58) Field of Classification Search ..... 381/60, 381/312, 316–318, 320–321
See application file for complete search history.

(56) References Cited

U.S. PATENT DOCUMENTS

| | | | |
|---|---|---|---|
| 4,759,070 | A | 7/1988 | Voroba et al. |
| 4,953,112 | A | 8/1990 | Widin et al. |
| 2004/0028250 | A1 | 2/2004 | Shim |
| 2005/0078842 | A1 | 4/2005 | Vonlanthen et al. |

FOREIGN PATENT DOCUMENTS

| | | |
|---|---|---|
| JP | 59-63899 | 4/1984 |
| JP | 2-83658 | 3/1990 |
| JP | 2001-197597 | 7/2001 |
| JP | 2001-204098 | 7/2001 |
| JP | 2006-165757 | 6/2006 |
| JP | 4222564 | 11/2008 |
| JP | 2009-70174 | 4/2009 |

OTHER PUBLICATIONS

Japanese Office Action issued Jan. 8, 2010 in Application No. 2009-273084.
European Search Report issued Apr. 1, 2011 in Application No. EP 10 19 3307.

*Primary Examiner* — Suhan Ni
(74) *Attorney, Agent, or Firm* — Wenderoth, Lind & Ponack, L.L.P.

(57) ABSTRACT

There is provided a hearing aid fitting apparatus with which the needs of a hearing aid user can be satisfied. The present invention is constituted such that this apparatus comprises an adjustment value input part 2 and a display part 3 on which is displayed hearing aid data set by this adjustment value input part 2, wherein first favorably assisted hearing aid data is selected from among first and second hearing aid data set by the adjustment value input part 2, then this selected first favorably assisted hearing aid data is compared with third hearing aid data set by the adjustment value input part and second favorably assisted hearing aid data is selected, after which the first and second favorably assisted hearing aid data are displayed on the display part, and hearing aid write data is selected from the first and second favorably assisted hearing aid data displayed on the display part.

3 Claims, 8 Drawing Sheets

HEARING AID FITTING APPARATUS

BACKGROUND OF THE INVENTION

1. Field of the Invention

The present invention relates to a hearing aid fitting apparatus.

2. Description of the Related Art

A conventional hearing aid fitting apparatus of this type was configured as follows.

This apparatus comprised an adjustment value input part and a display part on which hearing aid data set by this adjustment value input part was displayed. From among first and second hearing aid data set by the adjustment value input part and displayed on the display part, the first hearing aid data (for example) considered to be correct was selected, then this selected first hearing aid data was compared with third hearing aid data set by the adjustment value input part, the third hearing aid data (for example) considered to be correct was selected, and this process was then repeated a few times until the hearing aid data finally remaining was decided on as hearing aid write data (see Patent Literature 1 below, for example).

CITATION LIST

Patent Literature

Patent Literature 1: U.S. Pat. No. 4,222,564

SUMMARY OF THE INVENTION

Technical Problem

A problem encountered with the conventional example given above was that the satisfaction of the hearing aid user was not necessarily met completely.

Specifically, since the hearing aid user repeats the process of testing, comparing, and selecting sounds according to hearing aid data a number of times as mentioned above, despite the fact that hearing aid data is ultimately selected, the user often ends up wondering if the hearing aid data from a few times previously is better than this hearing aid data that is ultimately selected. Nevertheless, because it was he himself who selected this hearing aid data, the user may agree somewhat reluctantly to the ultimately selected hearing aid data, and this means that the hearing aid user does not necessarily feel completely satisfied.

In view of this, it is an object of the present invention to improve the sense of satisfaction felt by a hearing aid user.

Solution to Problem

The present invention achieves the stated object by a constitution comprising an adjustment value input part and a display part on which is displayed hearing aid data set by the adjustment value input part, wherein first favorably assisted hearing aid data is selected from among first and second hearing aid data set by the adjustment value input part and displayed on the display part, then this first favorably assisted hearing aid data is compared with third hearing aid data set by the adjustment value input part to select second favorably assisted hearing aid data, after which the first and second favorably assisted hearing aid data are displayed on the display part, and hearing aid write data is selected from the first and second favorably assisted hearing aid data displayed on the display part.

Advantageous Effects

As discussed above, the present invention comprises an adjustment value input part and a display part on which is displayed hearing aid data set by this adjustment value input part, wherein first favorably assisted hearing aid data is selected from among first and second hearing aid data set by the adjustment value input part, then this selected first favorably assisted hearing aid data is compared with third hearing aid data set by the adjustment value input part and second favorably assisted hearing aid data is selected, after which the first and second favorably assisted hearing aid data are displayed on the display part, and hearing aid write data is selected from the first and second favorably assisted hearing aid data displayed on the display part, so the sense of satisfaction felt by the hearing aid user can be improved. Specifically, with the present invention, repeating testing, comparison, and selection a number of times is the same, but the favorably assisted hearing aid data selected at each stage is displayed again on the display part, and the final hearing aid write data is again selected from this, so the hearing aid user can select final hearing aid write data that he agrees with, and as a result, the sense of satisfaction can be improved.

DESCRIPTION OF EMBODIMENTS

Embodiments of the present invention will now be described through reference to the appended drawings.

Embodiment 1

Figure 1:
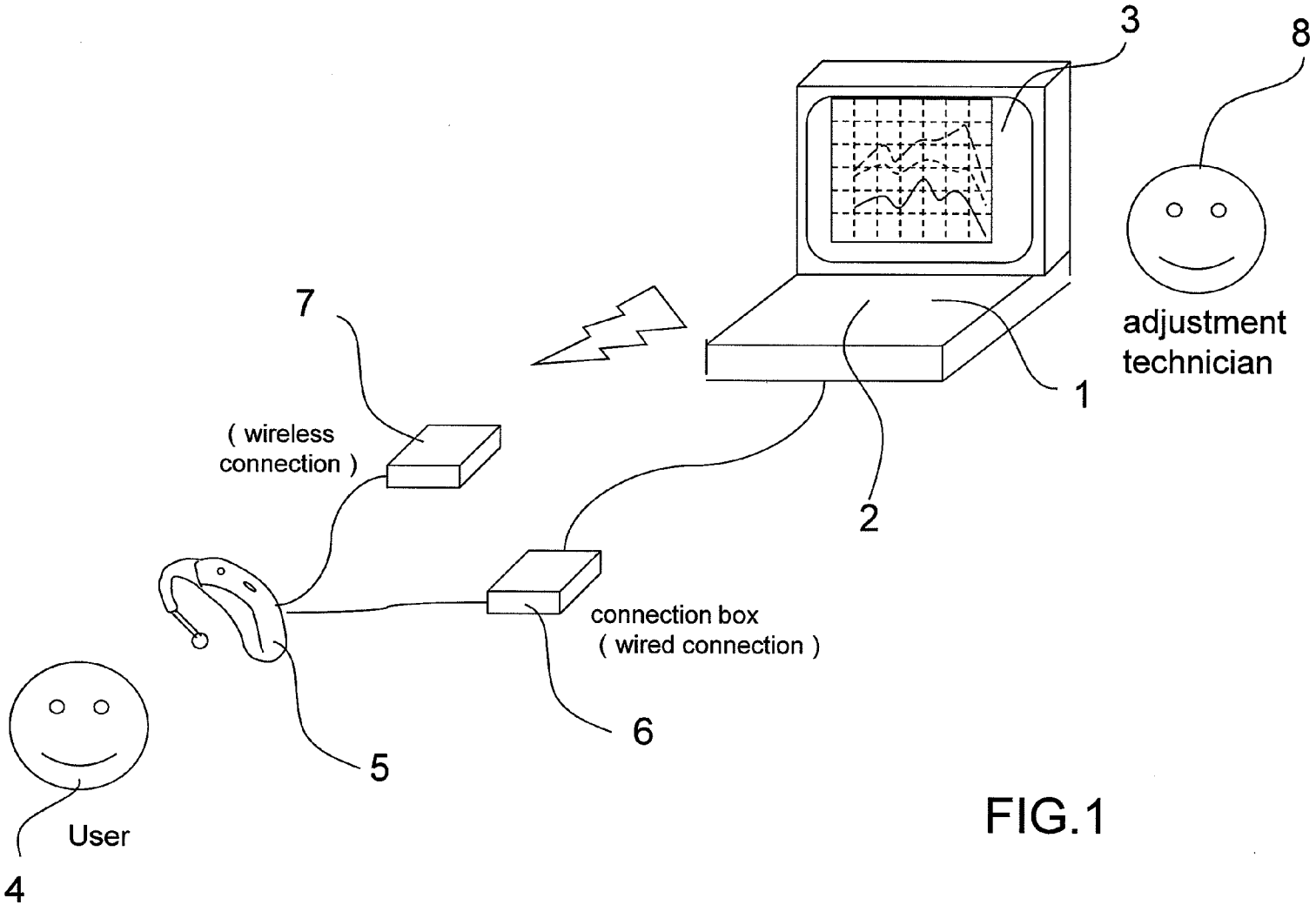
FIG. 1 is an oblique view pertaining to Embodiment 1 of the present invention.

FIG. 1 shows Embodiment 1 of the present invention. A hearing aid fitting apparatus 1 is constituted by an adjustment value input part 2 and a display part 3 on which is displayed hearing aid data set by the adjustment value input part 2. Also, the hearing aid fitting apparatus 1 and a hearing aid 5 of a user 4 are connected via a wired connection box 6 or a wireless connection box 7. Specifically, a fitting adjustment technician 8 first selects the hearing aid 5 by interviewing and testing the hearing of the user 4, and then performs fitting called a first fit, according to the results of the above-mentioned hearing test, in a state in which the hearing aid 5 is mounted on the ear of the user 4.

In this first fit, hearing aid data computed according to the results of the above-mentioned hearing test is inputted from the hearing aid fitting apparatus 1 to a hearing aid processor (not shown) of the hearing aid 5 via the wired connection box 6 or the wireless connection box 7. Fine adjustments are then made to complete the final fitting work. This fine adjustment will be described in detail below, but every time it is performed, hearing aid data is updated and inputted to the hearing aid processor (not shown) of the hearing aid 5 via the wired connection box 6 or the wireless connection box 7.

Figure 2:
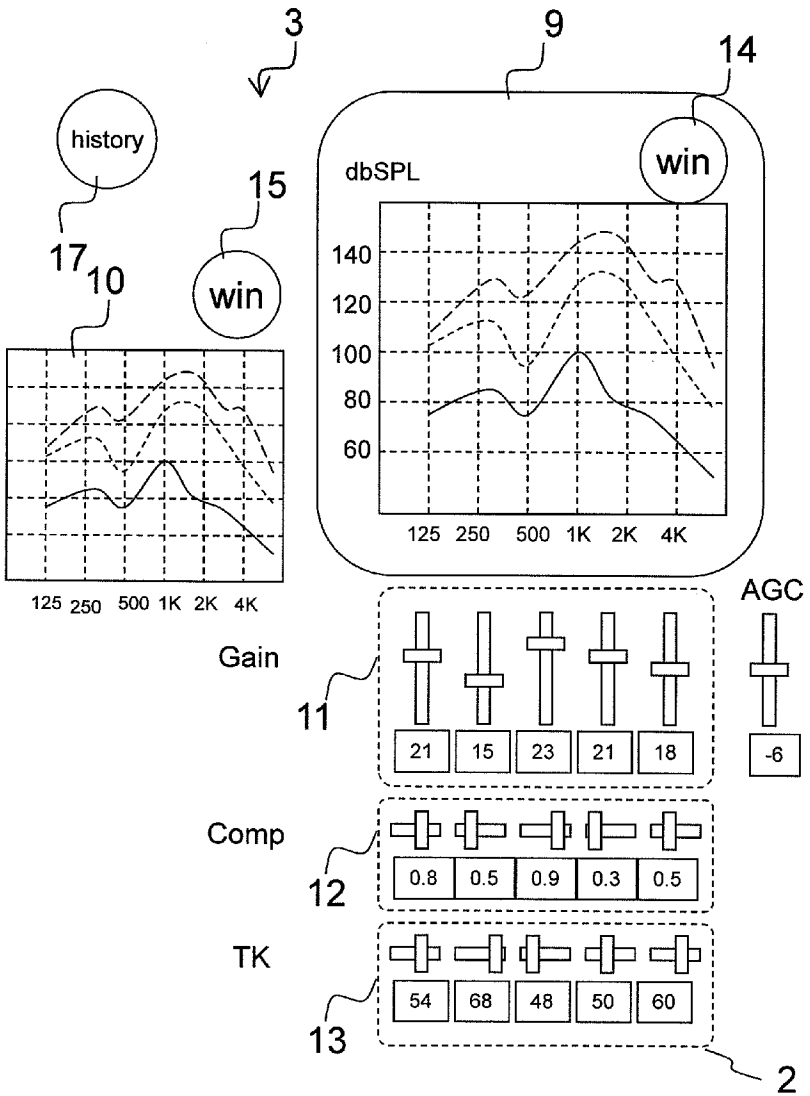
FIG. 2 is a diagram of the operation of the main parts of the same.
Figure 3:
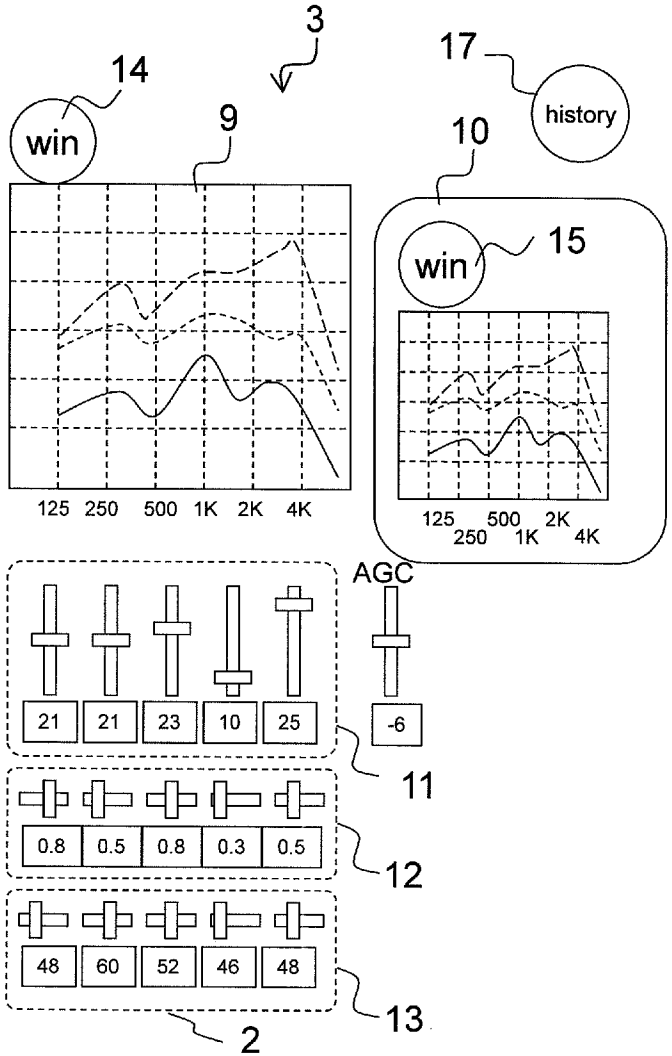
FIG. 3 is a diagram of the operation of the main parts of the same.

FIG. 2 is a simplified depiction of the adjustment value input part 2 and the display part 3 of the hearing aid fitting apparatus 1, and shows a screen 9, which shows the current hearing aid data for the right ear, and a screen 10, which shows the previous hearing aid data for the right ear, on the display part 3 shown in FIG. 1. As is commonly known, the adjustment value input part 2 is provided with an operating portion 11 for adjusting the gain, an operating portion 12 for setting inclination, an operating portion 13 for setting a bending point, and so forth. FIG. 3 shows the state when fitting to the left ear is performed after the work of fitting to the right ear as shown in FIG. 2. During the work of fitting to the right ear as shown in FIG. 2, the screen 10 showing the previous hearing aid data is to the left side of the screen 9 showing the current hearing aid data, but during the work of fitting to the left ear as shown in FIG. 3, the screen 10 showing the previous hearing aid data is to the right of the screen 9 showing the current hearing aid data.

Figure 4:
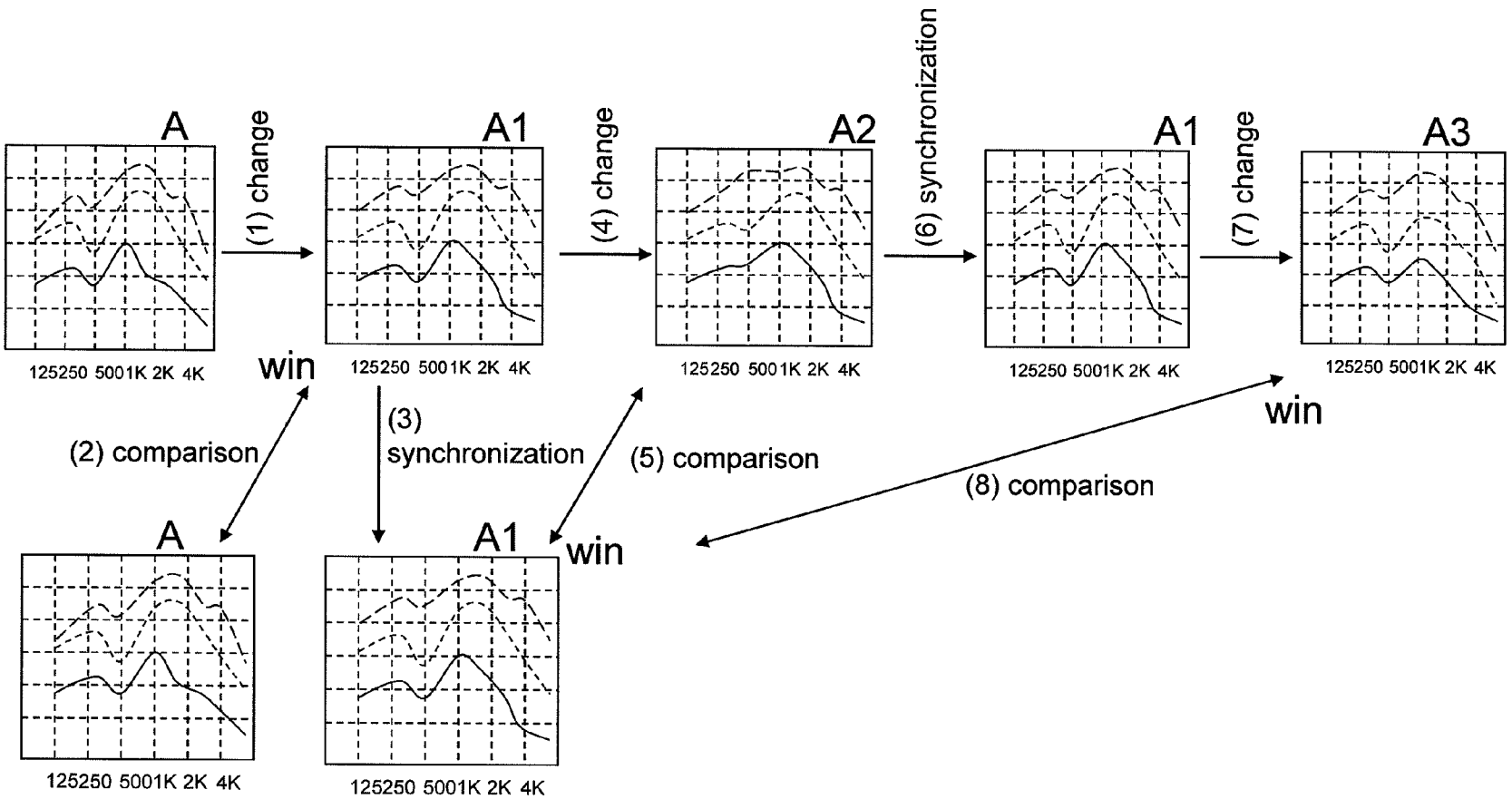
FIG. 4 is a diagram of the operation of the main parts of the same.

In this embodiment, the above-mentioned fine adjustment is performed as shown in FIG. 4. First, the same "hearing aid data A" is displayed on the screen 9 and screen 10 in FIG. 2. In this state, the hearing aid data A of screen 9 is changed by the adjustment value input part 2 into the "hearing aid data A1" in the change (1). Then, in the comparison (2), the "hearing aid data A1" of the screen 9 (first hearing aid data) is compared with the "hearing aid data A" of the screen 10 (second hearing aid data). That is, at this point the user 4 tries out the hearing aid 5 in a state in which the "hearing aid data A1" is written to the hearing aid processor (not shown), then the user 4 tries out the hearing aid 5 in a state in which the "hearing aid data A" is written to the hearing aid processor (not shown), and the user 4 decides which is preferable.

In this example, the user 4 decides that the "hearing aid data A1" of screen 9 is preferable, so the select key 14 on the screen 9 shown in FIG. 2 is pressed at this point. When this is done, this selected "hearing aid data A1" of the screen 9 (first favorably assisted hearing aid data) is also displayed on the screen 10 in the synchronization (3). Then, in the change (4), the "hearing aid data A1" is changed by the adjustment value input part 2 into "hearing aid data A2." Then, in the comparison (5), the "hearing aid data A2" of the screen 9 is compared with the "hearing aid data A1" of the screen 10. Here again, the user 4 tries out the hearing aid 5 in a state in which the "hearing aid data A2" is written to the hearing aid processor (not shown), then tries out the hearing aid 5 in a state in which the "hearing aid data A1" is written to the hearing aid processor (not shown), and decides which is preferable.

In this example, the user 4 decides that the "hearing aid data A1" of the screen 9 (second favorably assisted hearing aid data) is preferable, so the select key 15 on the screen 10 shown in FIG. 2 is pressed at this point. When this is done, this selected "hearing aid data A1" of the screen 9 is also displayed on the screen 10 in the synchronization (6).

Again, in the change (7), the "hearing aid data A1" is changed by the adjustment value input part 2 into "hearing aid data A3." Then, in the comparison (8), the "hearing aid data A3" of the screen 9 is compared with the "hearing aid data A1" of the screen 10. Here again, the user 4 tries out the hearing aid 5 in a state in which the "hearing aid data A3" is written to the hearing aid processor (not shown), then tries out the hearing aid 5 in a state in which the "hearing aid data A1" is written to the hearing aid processor (not shown), and decides which is preferable.

Figure 5:
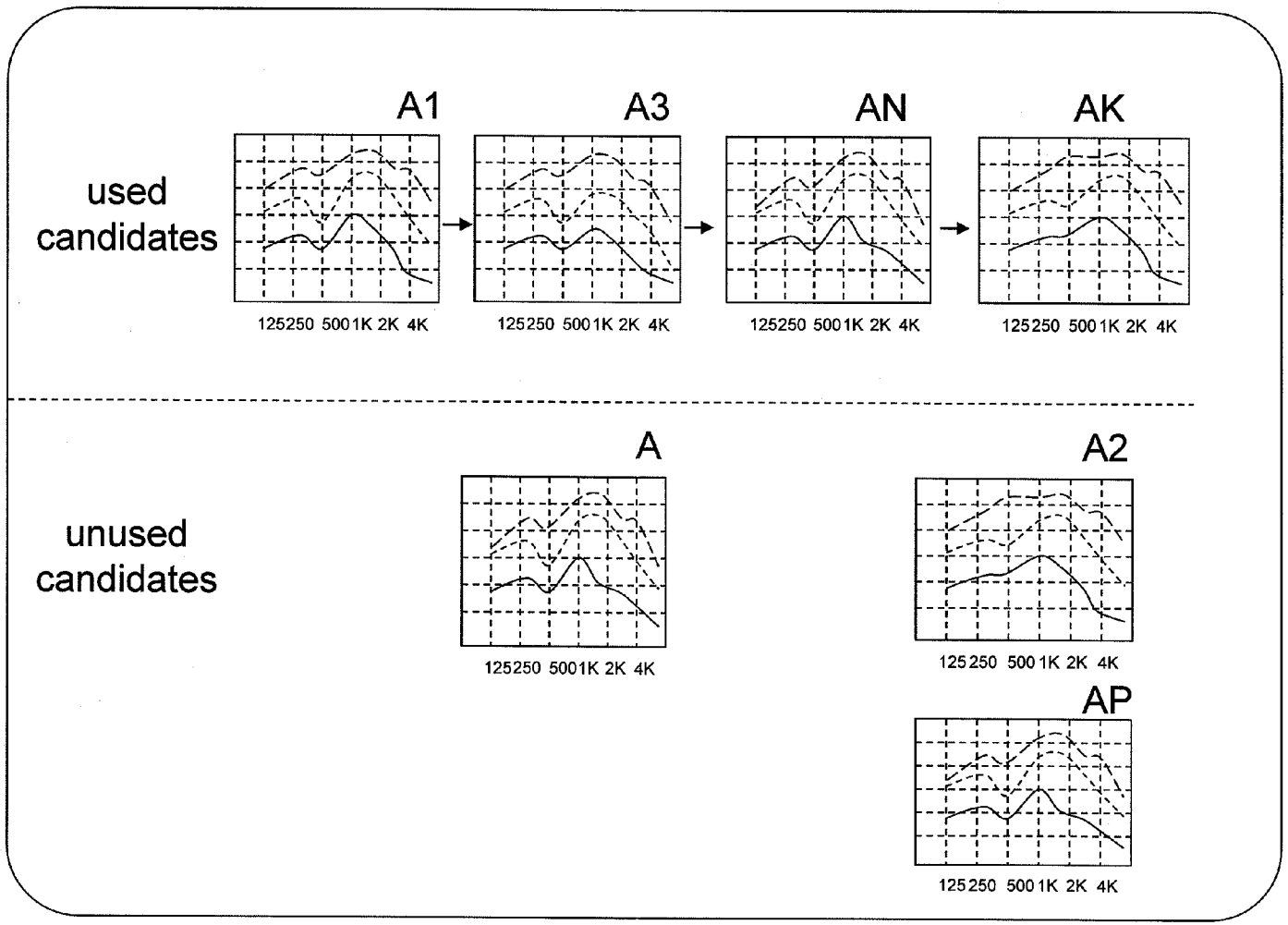
FIG. 5 is a diagram of the operation of the main parts of the same.

In this example, the user 4 decides that the "hearing aid data A3" of the screen 9 (third favorably assisted hearing aid data) is preferable, so the select key 14 on the screen 9 shown in FIG. 2 is pressed at this point. Thereafter, adjustment, testing, and comparison are continued, and the hearing aid data selected each time (A1, A3, AN, and AK in this example) is stored as favorably assisted hearing aid data as shown in FIG. 5 in the buffer 16 of FIG. 6 when the select keys 14 and 15 are pressed. Since the first favorably assisted hearing aid data and the second favorably assisted hearing aid data are the same at A1, they are stored as a single set of data.

Figure 6:
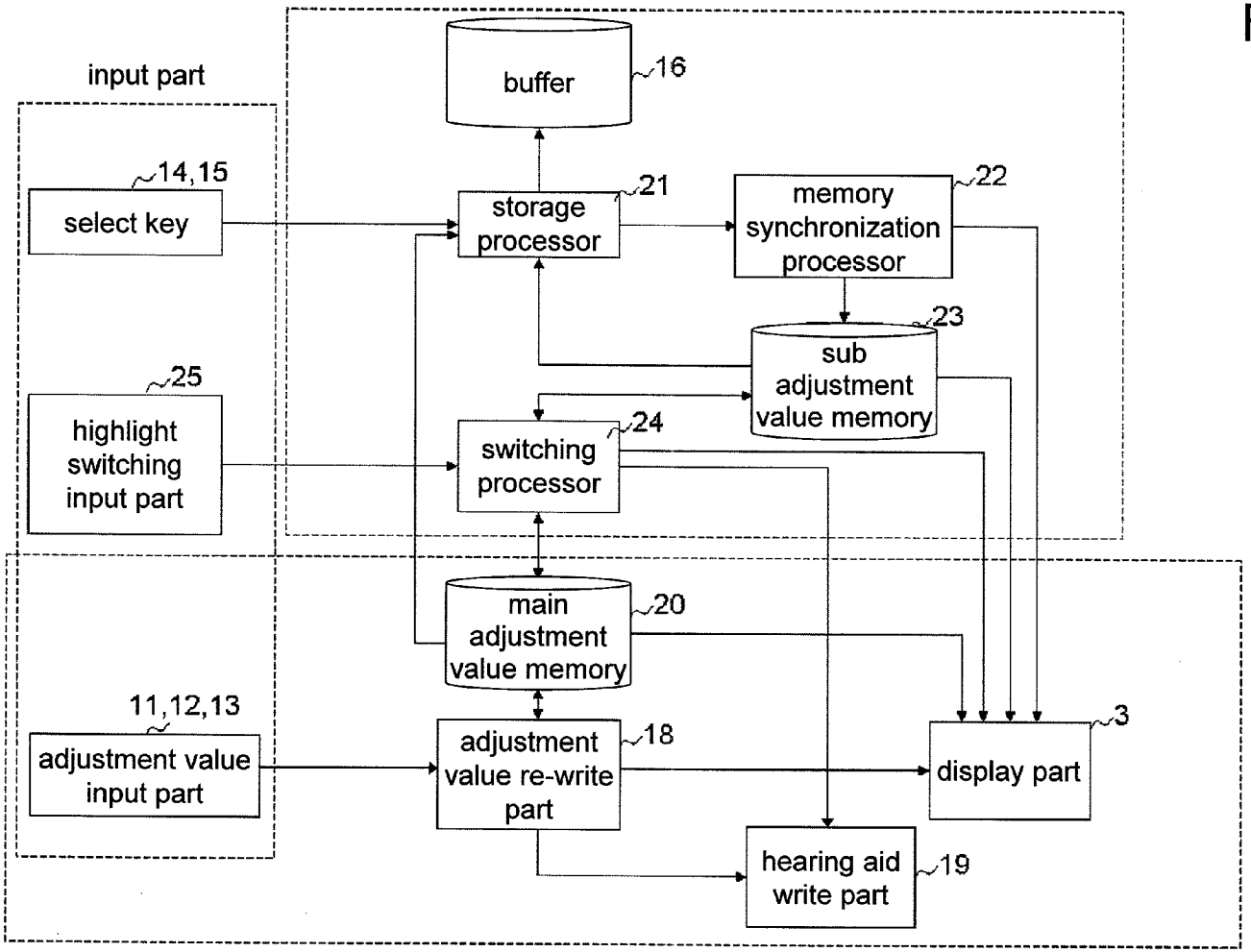
FIG. 6 is a control block diagram of the same.
Figure 8:
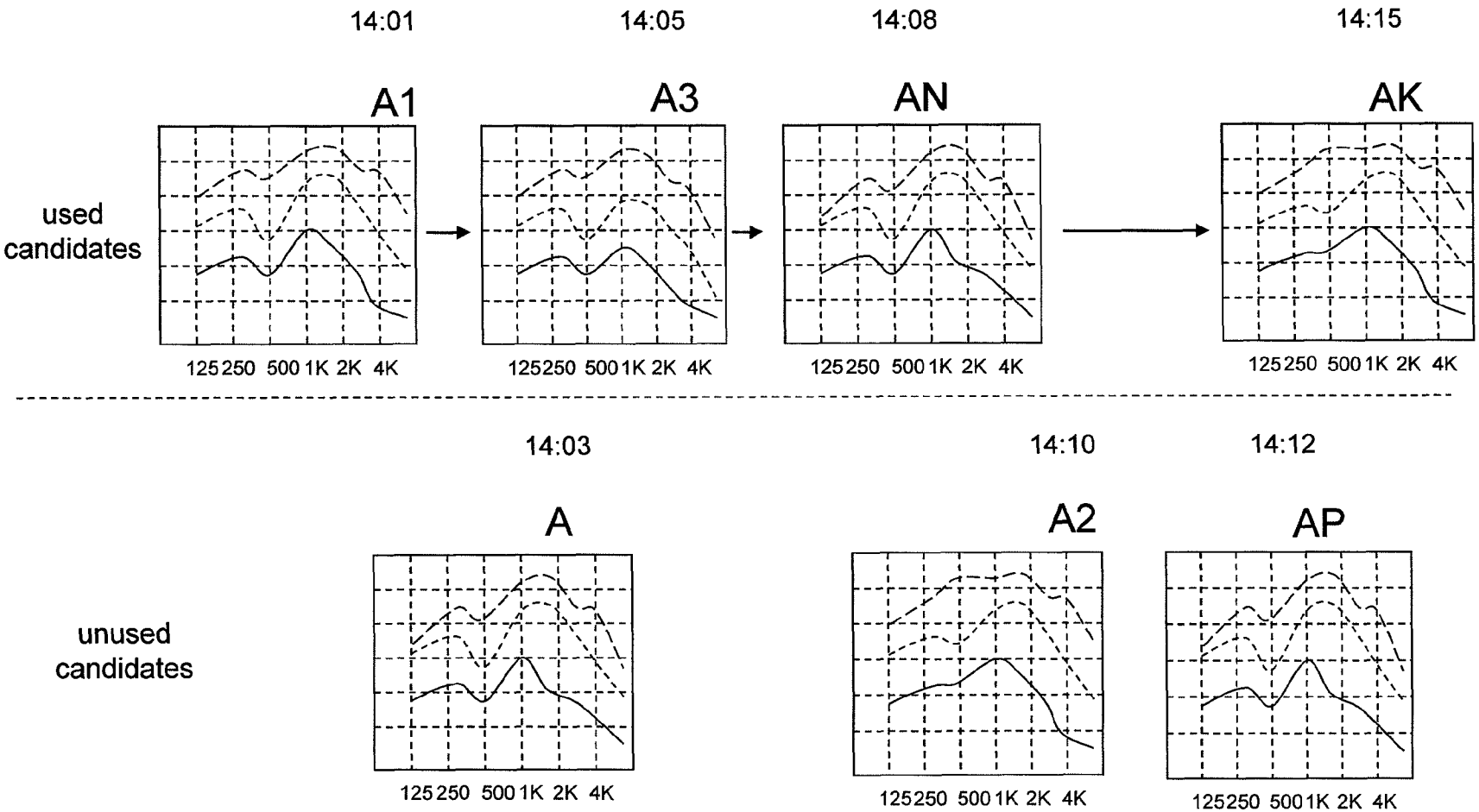
FIG. 8 is a diagram of the operation of the main parts of the same.

Also, in this embodiment, the hearing aid data A, A2, and Ap that were not selected are also stored in the buffer 16 of FIG. 6, as unfavorably assisted hearing aid data. However, since the hearing aid data A, A2, and Ap that were not selected and the hearing aid data A1, A3, AN, and AK that were selected are stored separately within the buffer 16, they can be called up separately at a later time. Also, by acquiring clock time information when the select keys 14 and 15 are pressed, the hearing aid data A1, A3, AN, and AK can be stored and retrieved along with time information as shown in FIG. 8, rather than FIG. 5.

As a result of the adjustment discussed above, the hearing aid data AK is finally selected, so a state results in which this hearing aid data AK is written to the hearing aid processor (not shown) of the hearing aid 5, but there may be situations in which the user is not certain about whether this hearing aid data AK was better than the hearing aid data A1, A3, AN and AK selected up to that point. In view of this, in this embodiment if the fitting adjustment technician 8 presses a history key 17 shown in FIGS. 2 and 3, just the hearing aid data A1, A3, and AN in the upper portion of FIG. 5 that is stored in the buffer 16 of FIG. 6 can be displayed on the display part 3.

Next, the fitting adjustment technician 8 successively touches the above-mentioned hearing aid data AK that was finally selected and the hearing aid data A1, A3, and AN, then has the user 4 try out the hearing aid again and decide which is preferable. The hearing aid data that is finally left after this comparison (such as A3) is written to the hearing aid processor (not shown) of the hearing aid 5.

The writing at this point is such that if the ultimately remaining hearing aid data A3 displayed on the display part 3 is touched, this hearing aid data A3 will be written to the hearing aid processor (not shown) of the hearing aid 5.

The fitting to the left ear shown in FIG. 3 is carried out in the same manner as the right ear fitting discussed above.

FIG. 6 is a block diagram of the hearing aid fitting apparatus 1, but the wired connection box 6, the wireless connection box 7, the hearing aid 5, and so forth that were shown in FIG. 1 are omitted. That is, an adjustment value re-write part 18 is connected to the operating portion 11 for adjusting the gain, the operating portion 12 for setting inclination, and the operating portion 13 for setting a bending point, and the display part 3, a hearing aid write part 19, and a main adjustment value memory 20 are connected to this adjustment value re-write part 18.

Also, a storage processor 21 is connected to the select keys 14 and 15, and the buffer 16 and a memory synchronization processor 22 are connected to the storage processor 21. A sub adjustment value memory 23 is connected to the memory synchronization processor 22, and the display part 3, the storage processor 21, and a switching processor 24 are connected to this sub adjustment value memory 23. A highlight switching input part 25 is connected to this switching processor 24. The switching processor 24 is used to switch input by successively touching the hearing aid data A1, A3, and AN of the upper portion of FIG. 5 displayed on the display part 3.

Figure 7:
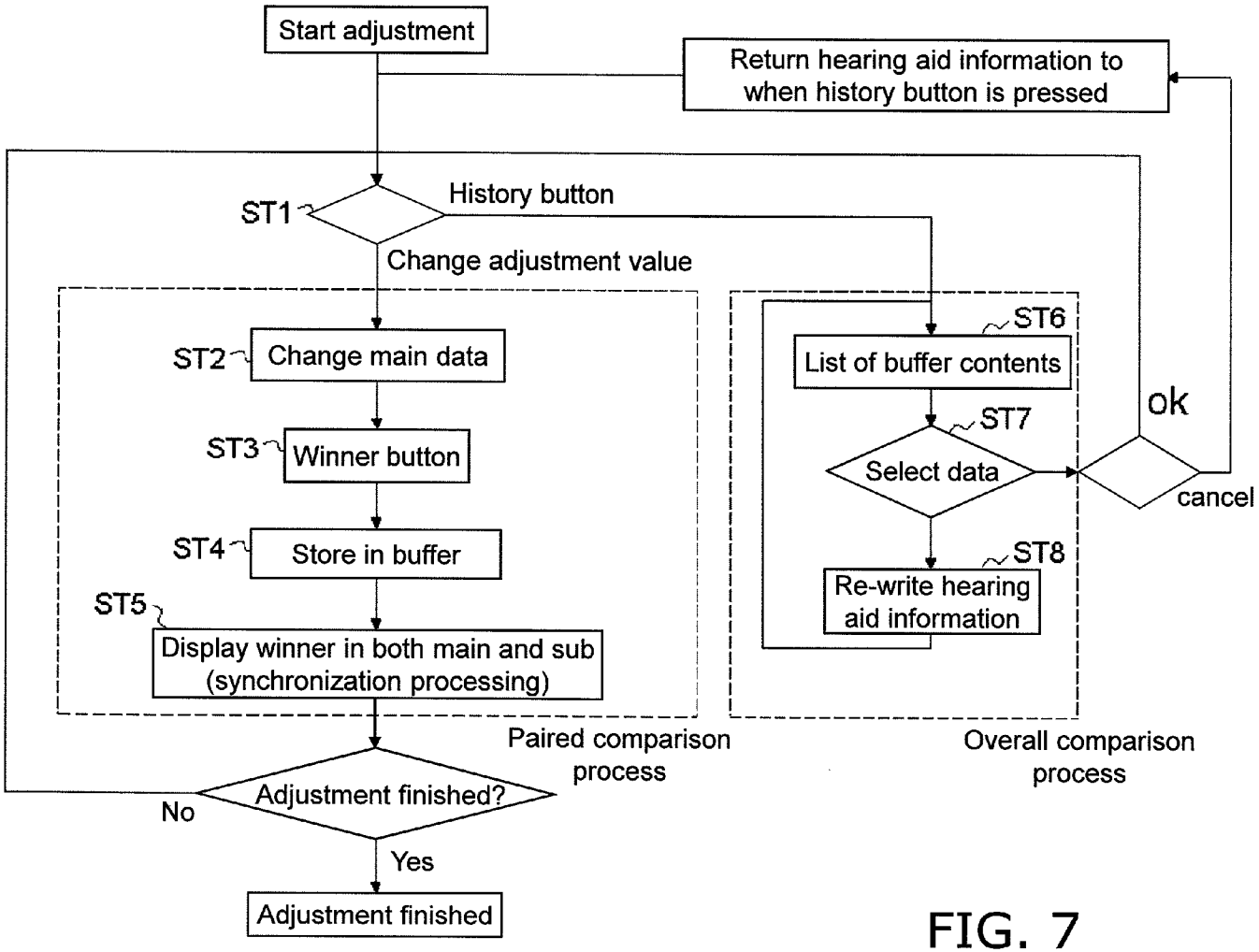
FIG. 7 is a flowchart of the operation of the same.

FIG. 7 is a flowchart of the above-mentioned fitting work. In ST1 to ST2, the adjustment value input part 2 changes from the hearing aid data A of FIG. 4 to the "hearing aid data A1" in the change (1). ST3 is a step in which the "hearing aid data A1" on the screen 9 and the "hearing aid data A" on the screen 10 are compared in the comparison (2) in FIG. 4, the user 4 decides that the "hearing aid data A1" on the screen 9 is preferable, and the select key 14 of the screen 9 shown in FIG. 2 is pressed at that point.

ST4 to ST5 refer to a state in which the selected "hearing aid data A1" on the screen 9 is displayed on the screen 10 by the synchronization (3). The above-mentioned ST1 to ST5 are then repeated as needed as discussed above. When the history key 17 is pressed, the flow moves to ST6, and in ST6 to ST8, there are shown a state in which the fitting adjustment technician 8 presses the history key 17 in FIGS. 2 and 3, and just the hearing aid data A1, A3, AN, and AK of the upper portion of FIG. 5 stored in the buffer 16 of FIG. 6, and the subsequent following state.

That is, a state is shown in which the fitting adjustment technician 8 successively touches the hearing aid data AK that was finally selected and the hearing aid data A1, A3, and AN, thereby having the user 4 try out the hearing aid again and decide which is preferable, and the hearing aid data that finally remains after this comparison (such as A3) is written to the hearing aid processor (not shown) of the hearing aid 5.

INDUSTRIAL APPLICABILITY

With the present invention, a hearing aid user can be satisfied in selecting final hearing aid write data, and as a result a greater sense of satisfaction can be achieved, so this hearing aid fitting apparatus is expected to find wide applicability.

REFERENCE SIGNS LIST

1 hearing aid fitting apparatus
2 adjustment value input part
3 display part
4 user
5 hearing aid
6, 7 connection box
8 adjustment technician
9, 10 screen
11, 12, 13 operating portion
14, 15 selection key
16 buffer
17 history key
18 adjustment value re-write part
19 hearing aid write part
20 main adjustment value memory
21 storage processor
22 memory synchronization processor
23 sub adjustment value memory
24 switching processor
25 highlight switching input part

The invention claimed is:

1. A hearing aid fitting apparatus, comprising an adjustment value input part, a display part on which is displayed hearing aid data set by the adjustment value input part, and a buffer that stores the hearing aid data, in which the hearing aid data is inputted to a hearing aid, a hearing aid user tries out the hearing aid to which the hearing aid data has been inputted, and adjustment of the hearing aid is performed by an adjustment technician, wherein first hearing aid data and second hearing aid data set by the adjustment value input part and displayed on the display part are compared, and the hearing aid data preferred by the hearing aid user is selected by the adjustment technician and is stored as first favorably assisted hearing aid data in the buffer, two sets of the first favorably assisted hearing aid data are synchronously displayed side by side on the display part, and one set of the first favorably assisted hearing aid data displayed on the display part is changed to third hearing aid data set by the adjustment value input part, the first favorably assisted hearing aid data is then compared with the third hearing aid data, and the hearing aid data that is preferred by the hearing aid user is selected by the adjustment technician and stored as second favorably assisted hearing aid data in the buffer, this process of comparison and selection is repeated so that the favorably assisted hearing aid data ultimately selected by the hearing aid user is displayed on the display part along with all of the favorably assisted hearing aid data previously selected by the hearing aid user, and the displayed favorably assisted hearing aid data is tried out by the hearing aid user again, the optimal hearing aid data is selected from the assisted hearing aid data, and the optimal hearing aid data is written by the adjustment technician as hearing aid write data to a hearing aid processor of the hearing aid.

2. The hearing aid fitting apparatus according to claim 1, wherein a history key is provided for reading out the first favorably assisted hearing aid data and the second favorably assisted hearing aid data from the buffer.

3. A hearing aid fitting method, in which a hearing aid user tries out a hearing aid to which hearing aid data has been inputted, and an adjustment technician performs adjustment of the hearing aid, said method comprising:

a first step in which first hearing aid data and second hearing aid data are displayed;

a second step in which the first hearing aid data and the second hearing aid data are compared, and the hearing aid data preferred by the hearing aid user is selected by the adjustment technician and stored as first favorably assisted hearing aid data;

a third step in which two sets of the first favorably assisted hearing aid data are synchronously displayed side by side, and one set of the displayed first favorably assisted hearing aid data is changed to third hearing aid data set and is displayed;

a fourth step in which the first favorably assisted hearing aid data is compared with the third hearing aid data, and the hearing aid data that is preferred by the hearing aid user is selected by the adjustment technician and is stored as second favorably assisted hearing aid data;

a fifth step in which the first step, the second step, the third step, and the fourth step are repeated so that the favorably assisted hearing aid data ultimately selected by the hearing aid user is displayed along with all of the favorably assisted hearing aid data previously selected by the hearing aid user in the second step and the fourth step; and a sixth step in which the favorably assisted hearing aid data displayed in the fifth step is tried out by the hearing aid user again, the optimal hearing aid data is selected from this, and the optimal hearing aid data is written by the adjustment technician as hearing aid write data to a hearing aid processor of the hearing aid.

* * * * *